US006988628B2

(12) United States Patent
Krieger et al.

(10) Patent No.: US 6,988,628 B2
(45) Date of Patent: Jan. 24, 2006

(54) CLOSET STORAGE SYSTEM

(75) Inventors: Douglas P. Krieger, Archbold, OH (US); Douglas B. Gerig, Archbold, OH (US)

(73) Assignee: Sauder Woodworking Company, Archbold, OH (US)

( * ) Notice: Subject to any disclaimer, the term of this patent is extended or adjusted under 35 U.S.C. 154(b) by 50 days.

(21) Appl. No.: 10/437,603

(22) Filed: May 14, 2003

(65) Prior Publication Data

US 2004/0055980 A1 Mar. 25, 2004

Related U.S. Application Data

(60) Provisional application No. 60/413,886, filed on Sep. 25, 2002.

(51) Int. Cl.
*A47F 5/00* (2006.01)

(52) U.S. Cl. ..... 211/86.01

(58) Field of Classification Search ..... 211/199, 211/86.01, 187, 189, 182, 85.3
See application file for complete search history.

(56) References Cited

U.S. PATENT DOCUMENTS

| | | | |
|---|---|---|---|
| 204,237 A | | 5/1878 | Miller et al. |
| 330,380 A | | 11/1885 | Cregmile |
| 563,467 A | | 7/1896 | Farwell |
| 622,666 A | | 4/1899 | Burwell |
| 779,262 A | | 1/1905 | Burke |
| 934,148 A | | 9/1909 | Duff |
| 1,682,060 A | | 8/1928 | Banks |
| 2,205,730 A | | 6/1940 | Morgan |
| 2,294,595 A | | 9/1942 | Dice |
| 2,545,844 A | | 3/1951 | Cougias |
| 2,888,305 A | | 5/1959 | Perry |
| 2,905,519 A | | 9/1959 | O'Neil |
| 3,061,395 A | | 10/1962 | Marateck et al. |
| 3,127,021 A | | 3/1964 | Nolen |
| 3,393,951 A | | 7/1968 | Sulentic |
| 3,400,829 A | | 9/1968 | Youngson |
| 3,465,763 A | | 9/1969 | Hoffman |
| 3,478,891 A | | 11/1969 | Kaeslin |
| 3,624,780 A | | 11/1971 | Elliot et al. |
| 3,698,782 A | | 10/1972 | Onori |
| 3,828,937 A | | 8/1974 | Nash |
| 3,836,218 A | | 9/1974 | Hallal |
| 3,891,288 A | | 6/1975 | Marquette |
| 3,966,056 A | | 6/1976 | Larson |
| 4,036,369 A | | 7/1977 | Eisenberg |
| 4,106,735 A | | 8/1978 | Partain et al. |
| 4,125,078 A | | 11/1978 | Nyquist |
| 4,192,562 A | | 3/1980 | Bishoff et al. |
| 4,206,955 A | * | 6/1980 | Cooper ..... 312/107 |
| 4,209,099 A | | 6/1980 | Wickes |

(Continued)

FOREIGN PATENT DOCUMENTS

GB 178984 2/1921

OTHER PUBLICATIONS

Web pages, Simple Closet, www.simplecloset.com, five pages (undated).

(Continued)

*Primary Examiner*—Sarah Purol
(74) *Attorney, Agent, or Firm*—MacMillan, Sobanski & Todd, LLC

(57) ABSTRACT

A closet storage system including a storage component and an adjustable and lockable engagement member. The engagement member engages the storage component to secure the storage component in position within a closet.

14 Claims, 10 Drawing Sheets

U.S. PATENT DOCUMENTS

| | | | | |
|---|---|---|---|---|
| 4,470,647 | A | 9/1984 | Bishoff et al. | |
| 4,478,337 | A | 10/1984 | Flum | |
| 4,508,231 | A | 4/1985 | Honickman | |
| 4,535,896 | A | 8/1985 | Evenson | |
| 4,553,523 | A | 11/1985 | Stohrer, Jr. | |
| 4,696,406 | A | 9/1987 | Karashima | |
| 4,718,132 | A | 1/1988 | Wirland | |
| 4,723,665 | A | 2/1988 | Benedict et al. | |
| 4,765,495 | A | 8/1988 | Bisk | |
| 4,832,422 | A | 5/1989 | Fortmann | |
| 4,895,471 | A * | 1/1990 | Geltz et al. | 403/104 |
| 4,928,833 | A | 5/1990 | Huizenga | |
| 4,938,365 | A | 7/1990 | Conway et al. | |
| 5,100,216 | A | 3/1992 | Enns | |
| 5,191,986 | A | 3/1993 | Huizenga | |
| 5,277,512 | A | 1/1994 | Dwillies | |
| 5,295,596 | A | 3/1994 | Squitieri | |
| 5,337,905 | A | 8/1994 | Gast | |
| D355,551 | S | 2/1995 | McNamara et al. | |
| 5,423,597 | A | 6/1995 | Rogers | |
| 5,441,162 | A | 8/1995 | Niblock | |
| 5,460,440 | A | 10/1995 | Moauro | |
| 5,466,058 | A | 11/1995 | Chan | |
| 5,549,377 | A | 8/1996 | Krivec | |
| 5,553,824 | A | 9/1996 | Dutra, Jr. | |
| 5,564,577 | A | 10/1996 | Knaggs | |
| 5,582,306 | A | 12/1996 | Balter et al. | |
| 5,586,666 | A | 12/1996 | Squitieri | |
| 5,601,016 | A | 2/1997 | Witte | |
| 5,605,238 | A | 2/1997 | Jacobs | |
| 5,762,208 | A | 6/1998 | Yeh | |
| 5,819,958 | A | 10/1998 | Dement | |
| 5,826,955 | A | 10/1998 | Sanders et al. | |
| 5,992,647 | A | 11/1999 | Malik | |
| 6,021,908 | A | 2/2000 | Mathews | |
| 6,142,321 | A | 11/2000 | West | |
| D444,332 | S | 7/2001 | Zemke, Jr. et al. | |
| D444,655 | S | 7/2001 | West | |
| D444,656 | S | 7/2001 | West | |
| D444,974 | S | 7/2001 | West | |
| D444,975 | S | 7/2001 | West | |
| D445,618 | S | 7/2001 | West | |
| D445,620 | S | 7/2001 | West | |
| D455,585 | S | 4/2002 | West | |
| 6,443,318 | B1 * | 9/2002 | Welsch | 211/90.02 |

OTHER PUBLICATIONS

Web pages, Homescape Systems, www.homescapeclosets.com, three pages (undated).

* cited by examiner

FIG. 19
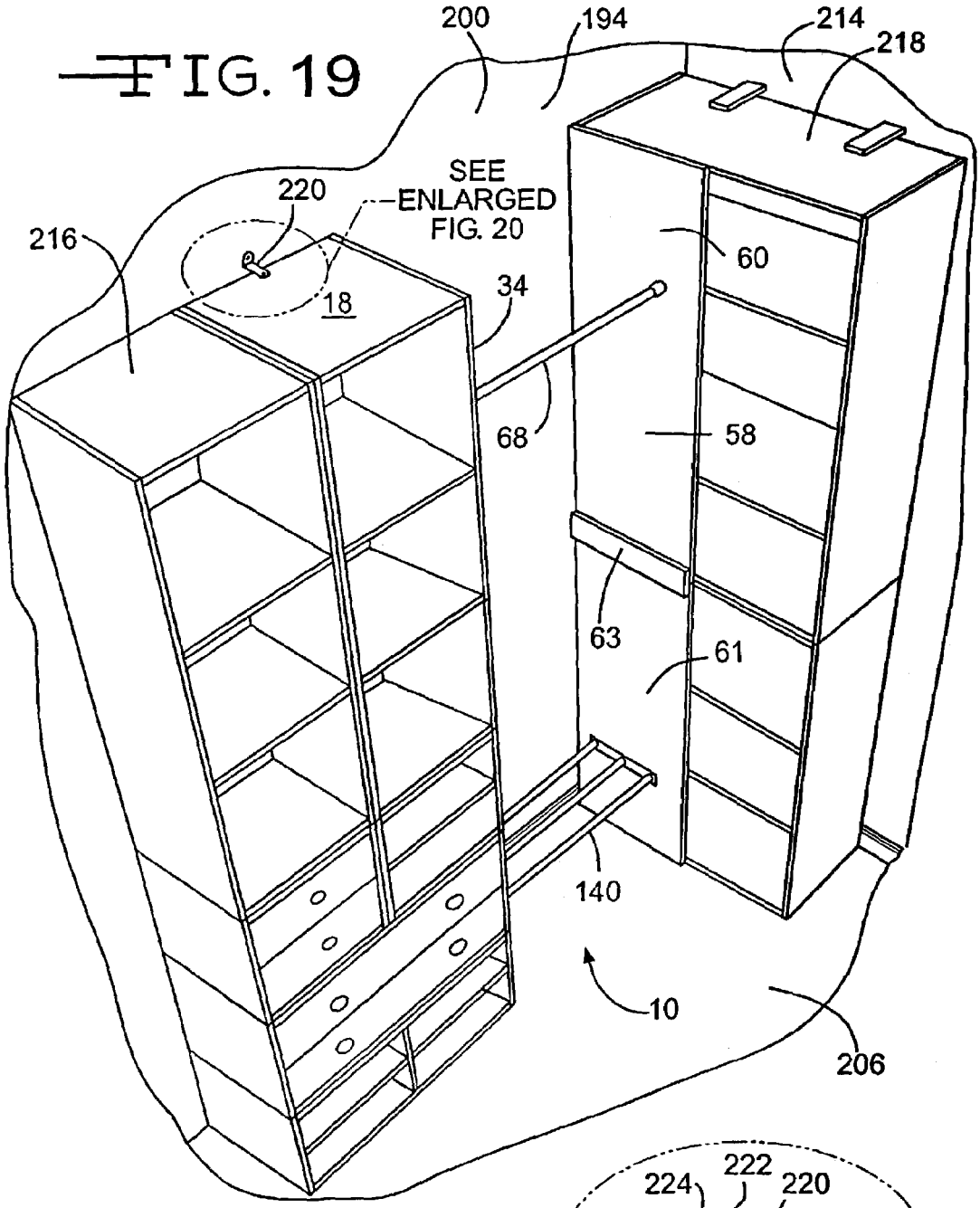
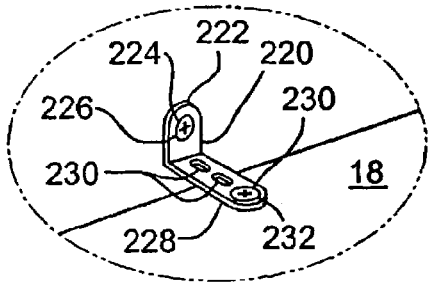
FIG. 20

CLOSET STORAGE SYSTEM

RELATED APPLICATION

The present application is related to and claims the benefit of U.S. Provisional Application No. 60/413,886, filed on Sep. 25, 2002.

BACKGROUND OF THE INVENTION

The present invention is generally directed to a closet storage system. More specifically, the invention is directed to a closet storage system that includes a storage component and an adjustable and lockable engagement member for engaging the storage component to secure the storage component in a closet.

A traditional closet includes two spaced, opposed sidewalls with a back wall extending between the sidewalls. A closet rod extends between the sidewalls. Sometimes, there is a shelf that extends between the sidewalls above the closet rod. This arrangement works well for hanging clothing items such as dresses or suits. Some articles of clothing, such as sweaters can be folded and placed on the shelf. However, much of the closet space is unutilized.

Within the past few years, various types of closet systems have been developed to utilize the space that has not been utilized in a traditional closet. These systems include various types of shelves and closet rods. The systems are attached to the closet walls by fastening devices such as screws, bolts and brackets, which damage the walls of the closet as well as any woodwork within the closet. These types of systems are designed for permanent installation in the closet. As it will be appreciated, these types of systems are unacceptable for those persons who do not want damaged closet walls. They are also unacceptable for those people, such as apartment dwellers, who want to disassemble the closet system and move it to a new location.

It has been found that there is a need for a closet storage system that can be easily and quickly placed in an existing closet and disassembled for transportation to another location without damaging closet walls. The present invention satisfies this and other needs.

SUMMARY OF THE INVENTION

The present invention is directed to a closet storage system that includes one or more storage components. The storage component is secured in a closet by an adjustable and lockable engagement member.

The primary object of present invention is to provide a closet storage system that can be easily and quickly assembled in an existing closet and disassembled for removal to another location without damaging closet walls.

Other objects and advantages of the present invention will now be described in detail with reference being made to the accompanying drawings.

BRIEF DESCRIPTION OF THE DRAWINGS

FIG. 19 is an alternative embodiment closet storage system according to the present invention; and FIG. 20 is an enlarged view of the area indicated in FIG. 19.

DETAILED DESCRIPTION OF THE PREFERRED EMBODIMENTS

Figure 1:
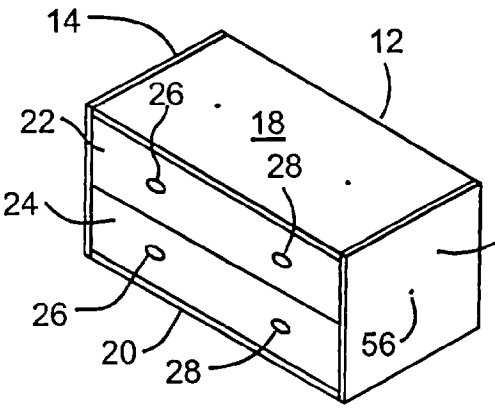
FIG. 1 is a perspective view of a large two-drawer storage component according to the present invention.

The preferred embodiments and best mode of the present invention will now be described in detail with reference being made to the drawings. In the drawings, the closet storage system of the present invention is indicated generally by the reference number "10".

Referring to FIGS. 1–7, a large two-drawer storage component 12 is shown in FIG. 1. The component 12 includes a first sidewall 14 spaced from a second sidewall 16, a top 18 and a bottom 20. The component 12 includes a top drawer 22 and a bottom drawer 24 positioned between the first and second sidewalls 14 and 16. Each of the drawers 22 and 24 includes a first handle 26 and a second handle 28.

Figure 2:
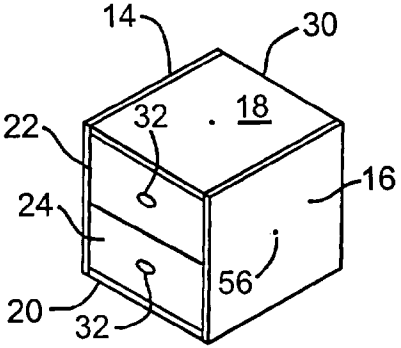
FIG. 2 is a perspective view of a small two-drawer storage component according to the present invention.

A small two-drawer storage component 30 is shown in FIG. 2. The component 30 includes the elements of the component 12 shown in FIG. 1. Accordingly, the same reference numbers have been used. However, the top and bottom drawers 22 and 24 each includes a single handle 32.

Figure 3:
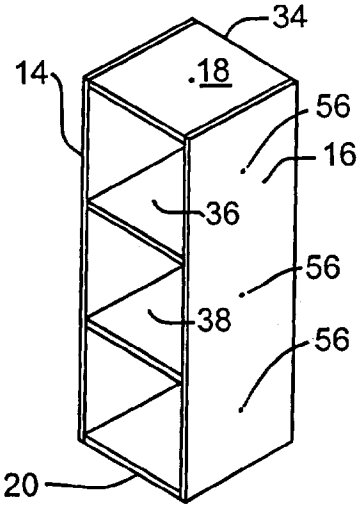
FIG. 3 is a perspective view of a small two-shelf storage component according to the present invention.

A small two-shelf storage component 34 is shown in FIG. 3. The component 34 includes first and second sidewalls 14 and 16, a top 18 and a bottom 20. The component 34 further includes a top shelf 36 and a bottom shelf 38 positioned between the first and second sidewalls 14 and 16.

Figure 4:
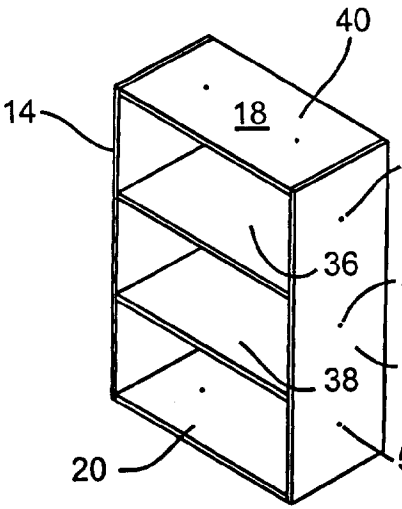
FIG. 4 is a perspective view of a large two-shelf storage component according to the present invention.

A large two-shelf storage component 40 is shown in FIG. 4. The component 40 includes the same elements as the component 34. Accordingly, the same reference numbers have been used.

Figure 5:
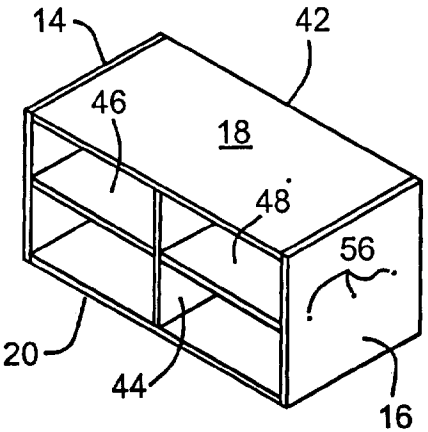
FIG. 5 is a perspective view of a shoe storage component according to the present invention.

A shoe storage component 42 is shown in FIG. 5. The component 42 includes first and second spaced sidewalls 14 and 16, a top 18 and a bottom 20. The component 42 further includes a center wall 44 that extends between the top and bottom 18 and 20 parallel to the first and second sidewalls 14 and 16. A first shelf 46 extends between the first sidewall 14 and the center wall 44. A second shelf 48 extends between the center wall 44 and the second sidewall 16.

Figure 6:
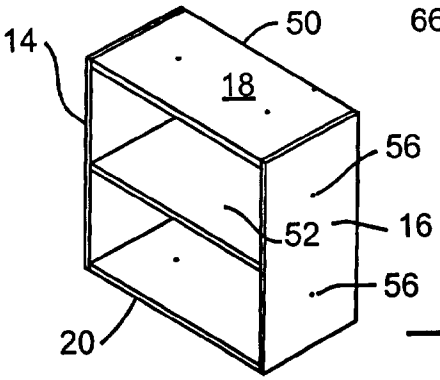
FIG. 6 is a perspective view of a small one-shelf storage component according the present invention.

A small one-shelf storage component 50 is shown in FIG. 6. The component 50 includes the elements of the component 34 shown in FIG. 3. Accordingly, the same reference numbers have been used. However, the component 50 includes a single shelf 52 positioned between the first and second sidewalls 14 and 16.

Figure 18:
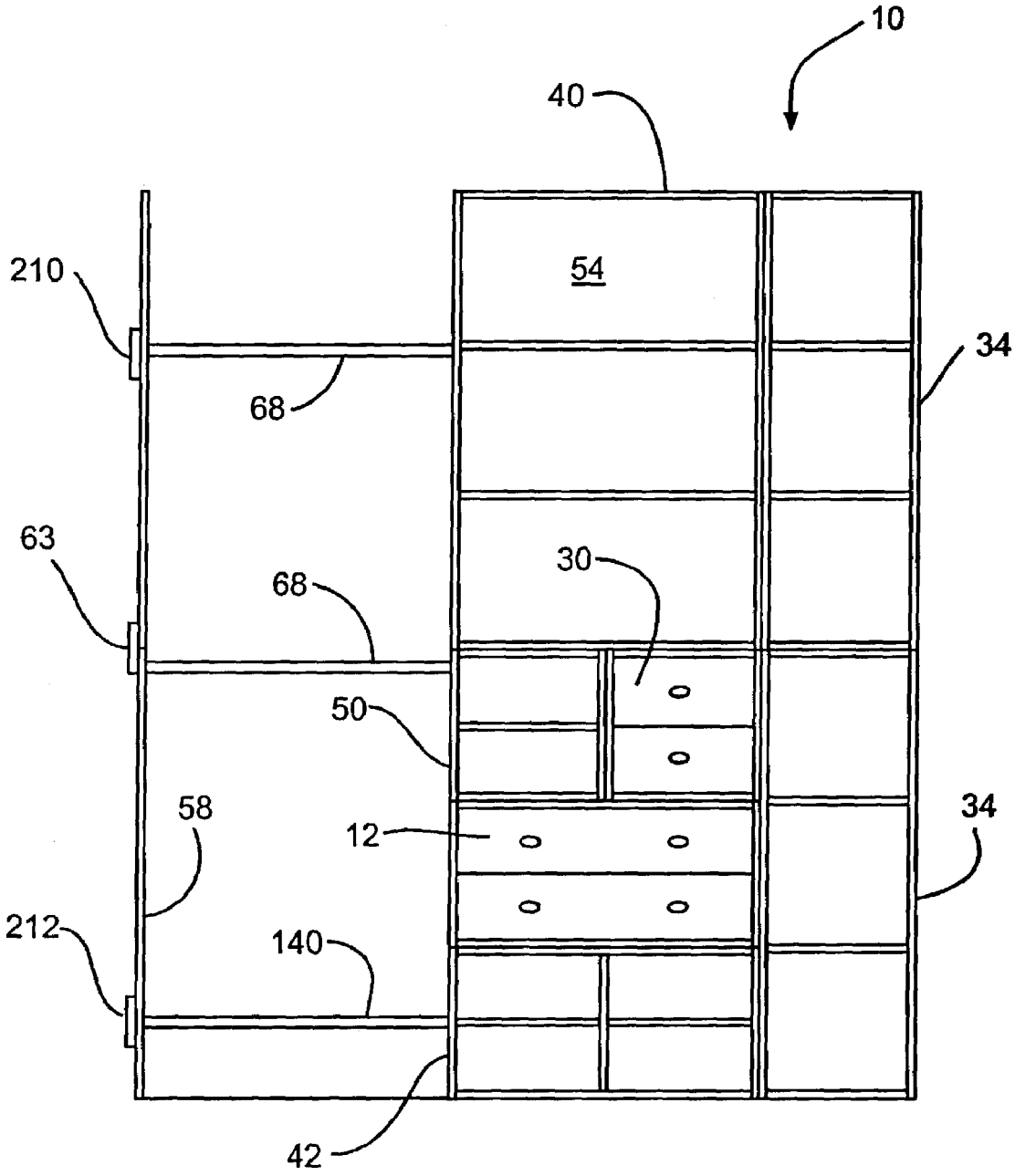
FIG. 18 is an alternative embodiment closet storage system according to the present invention.

Each of the components 12, 30, 34, 40, 42 and 50 includes a back panel that extends between the first and second sidewalls 14 and 16 and the top and bottom 18 and 20. A back panel 54 is shown in FIG. 18 for the component 40. This is representative of the back panels for the other components. The components 12, 30, 34, 40, 42 and 50 each includes one or more openings 56.

Figure 7:
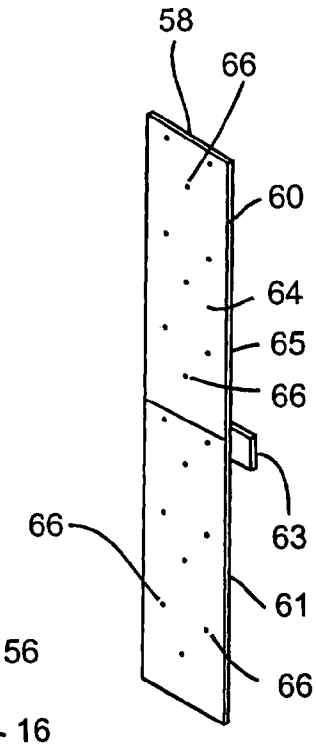
FIG. 7 is a perspective of an upright member according to the present invention.
Figure 17:
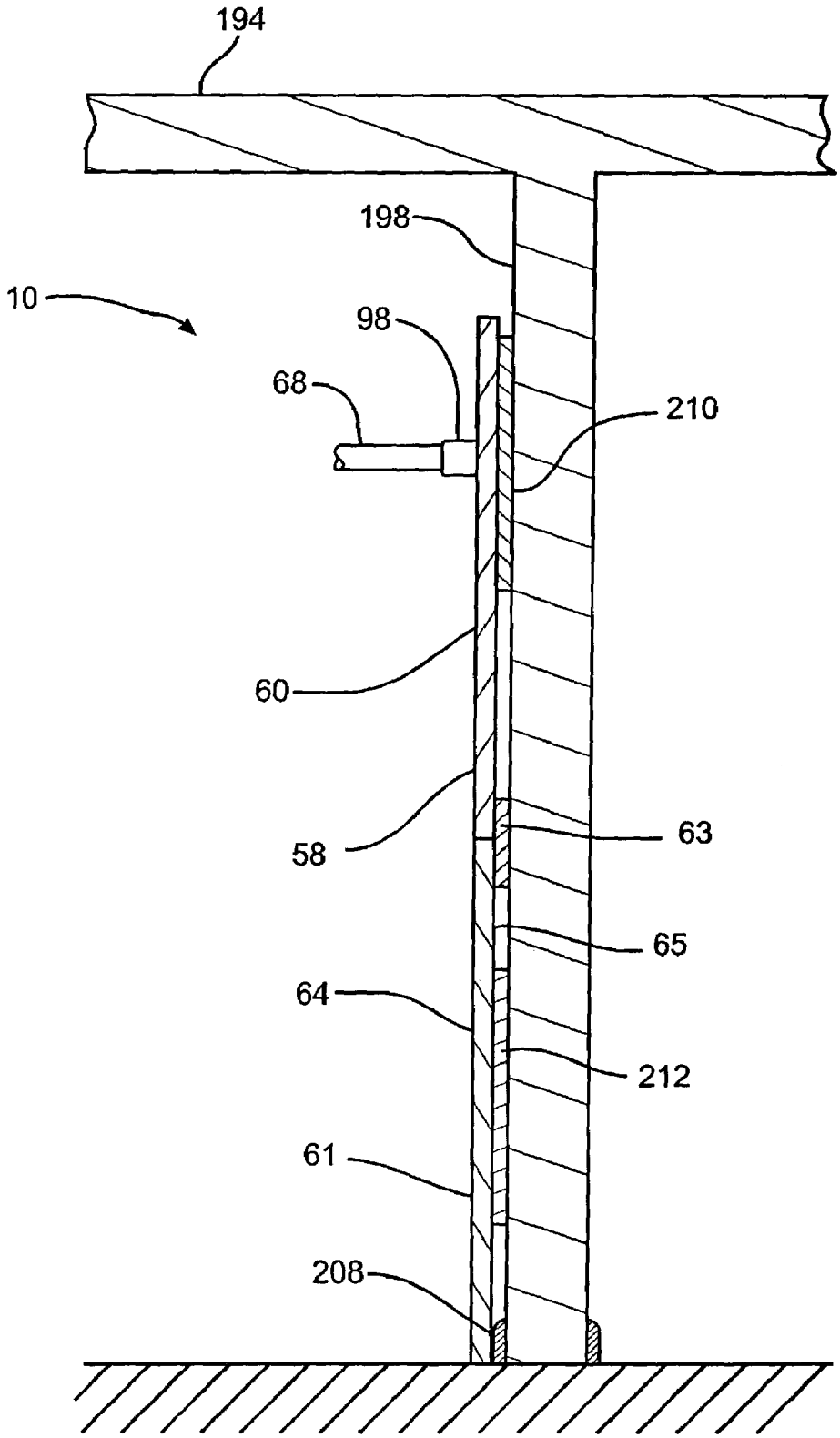
FIG. 17 is a cross-sectional view taken along line 17—17 of FIG. 15.

As shown in FIGS. 7 and 17, the system 10 includes an upright member 58. In this embodiment, the member 58 includes an upper section 60 and a lower section 61. The upper section 60 is joined to the lower section 61 by a connection member 63. The upright member 58 has a first side 64 and a second side 65. The upright member 58 includes one or more openings 66.

In a preferred embodiment, the components 12, 30, 34, 40, 42 and 50 and the upright member 58 are constructed of laminated compressed particleboard. They are "ready-to-assembly" wherein they are distributed unassembled for assembly by the user at the place of installation of the system 10.

Figure 8:
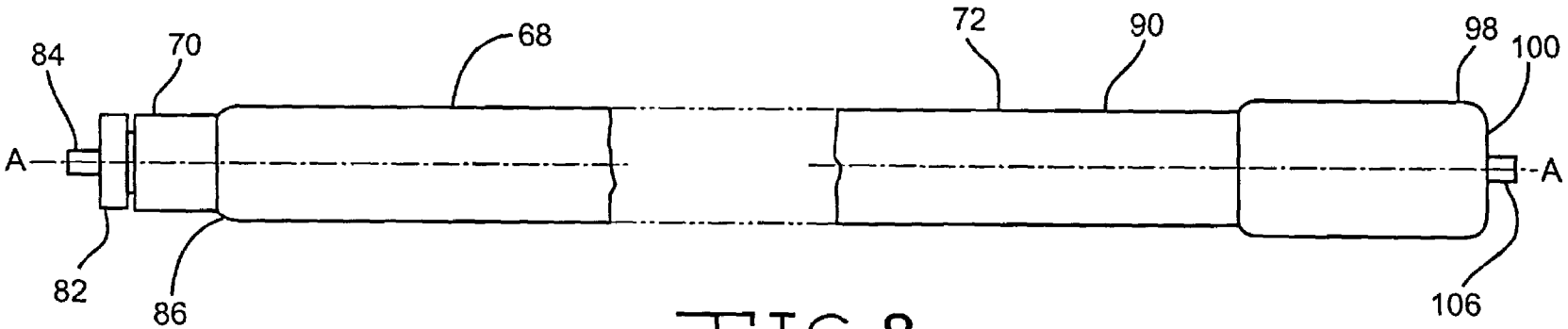
FIG. 8 is a front elevational view of a closet rod engagement member according to the present invention.
Figure 9:
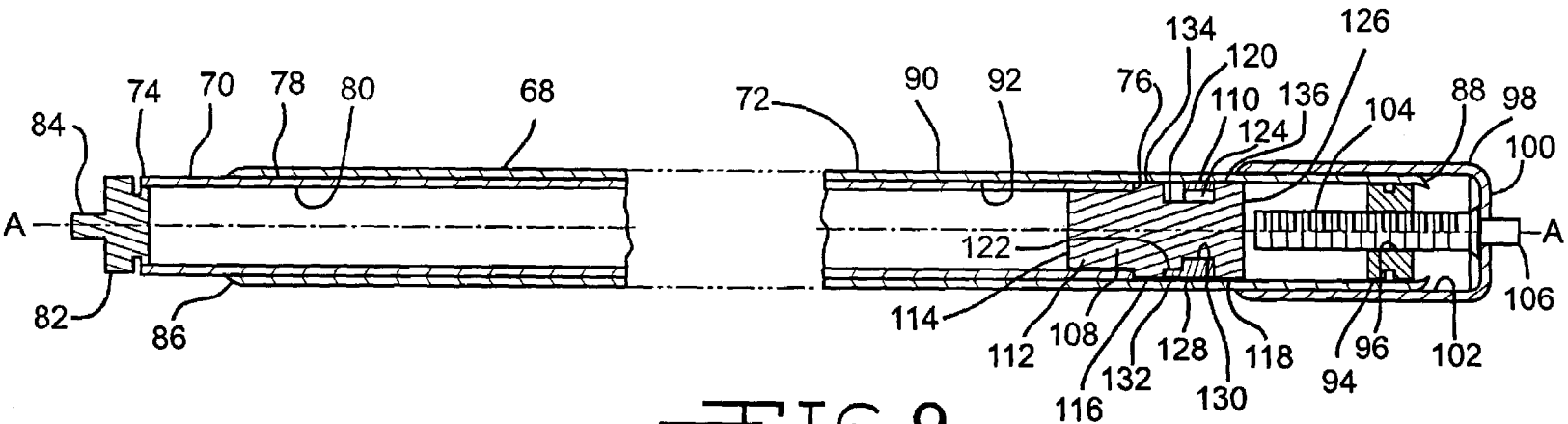
FIG. 9 is a cross-sectional view of the engagement member shown in FIG. 8.

Referring now to FIGS. 8 and 9, the system 10 includes an adjustable and lockable engagement member such as a closet rod 68. In this embodiment, the rod 68 includes a first section 70 slidingly positioned in a second section 72. The first and second section 70 and 72 are elongated and have cylindrical shapes extending about a longitudinal axis A—A.

As best shown in FIG. 9, the first section 70 includes a first end 74, a second end 76, an exterior surface 78 and an interior surface 80. A projection member 82 having a projection 84 is positioned on the first end 74. The projection 84 is sized and adapted for insertion in one of the openings 56 of the components 12, 30, 34, 40, 42 and 50 or one of the openings 66 of the upright member 58 as shown in FIGS. 1–7. The projection 84 is positioned along the axis A—A.

Still referring to FIGS. 8 and 9, the second section 72 includes a first end 86, a second end 88, an exterior surface 90 and an interior surface 92. The O.D. of the first section 70 as defined by the exterior surface 78 is slightly less than the I.D. of the second section 72 as defined by the interior surface 92. The second end 88 includes a bolt securement member 94 that includes a threaded opening 96. In this embodiment, an end member 98 having an exterior surface 100 and an interior surface 102 is positioned on the second end 88 of the second section 72. The interior surface 102 houses a threaded bolt 104 that is aligned with the axis A—A. The bolt 104 is rotatably positioned in the opening 96 to removably attach the end member 98 to the second section 72. A projection member 106 is positioned on the exterior surface 100 of the end member 98 in alignment of the axis A—A. The projection 106 is sized and adapted to be positioned in one of the openings 56 or 66 as shown in FIGS. 1–7. In a preferred embodiment, the first and second sections 70 and 72 and the end member 98 are constructed of metal.

As shown in FIG. 9, a locking device 108 is positioned on the second end 76 of the first section 70. In this embodiment, the locking device 108 includes an eccentric cam 110 moveably and rotatably mounted on a cam holder 112. The cam holder 112 includes a first end 114, a first cylindrical section 116, a second cylindrical section 118 and a reduced cylindrical section 120 having a stop 122. The first and second cylindrical sections 116 and 118 are positioned on-center with respect to the axis A—A. The reduced cylindrical section 120 is positioned off-center with respect to the axis A—A. As shown in FIG. 9, a cavity 124 is defined between the first and second cylindrical sections 116 and 118 around the reduced cylindrical section 120. The cam holder 112 includes a second end 126.

Still referring to FIG. 9, the cam 110 includes a cylindrical exterior surface 128 and a cylindrical interior surface 130. The cam 110 has a split-ring compressible construction. The cam 110 is rotatably mounted on the reduced cylindrical section 120 of the cam holder 112 in the cavity 124. The cam 110 includes engagement portions 132 that engage the stop 122 to restrict rotational movement of the cam with respect to the reduced cylindrical section 120. As it will be appreciated, the off-center positioning of the reduced cylindrical section 120 makes the cam 110 eccentrically mounted. As the cam 110 is rotated on the reduced cylindrical section 120, the exterior surface 128 of the cam 110 moves from a position in which the exterior surface is flush with the exterior surfaces 134 and 136 of the first and second cylindrical sections 112 and 118, respectively, to a position in which a portion of the exterior surface 128 of the cam 110 extends beyond the exterior surfaces 134 and 136. In a preferred embodiment, the locking device 108 is constructed of plastic.

The rod 68 is operated by sliding the first and second sections 70 and 72 with respect to one another to adjust the rod to a desired length. In one embodiment, the rod 68 can be adjusted within a range of 23 to 38 inches. Once the rod 68 is adjusted, the first section 70 is turned in a first direction with respect to the second section 72. This causes the cam 110 to rotate on the reduced cylindrical section 120 until the engagement portions 132 engage the stop 122. The exterior surface 128 of the cam 110 then firmly engages the interior surface 92 of the second section 72 to horizontally lock the first section 70 to the second section 72. The turning of the first section 70 in a second direction opposite to the first direction causes the cam 110 to travel in the opposite direction so that it disengages the interior surface 92 of the second section 72 to allow the first section to unlock and slide within the second section.

Figure 11:
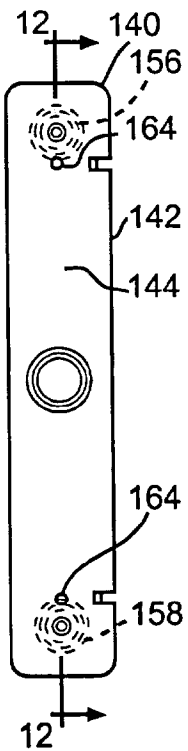
FIG. 11 is a side elevational view of an end plate of the engagement member shown in FIG. 10.
Figure 10:
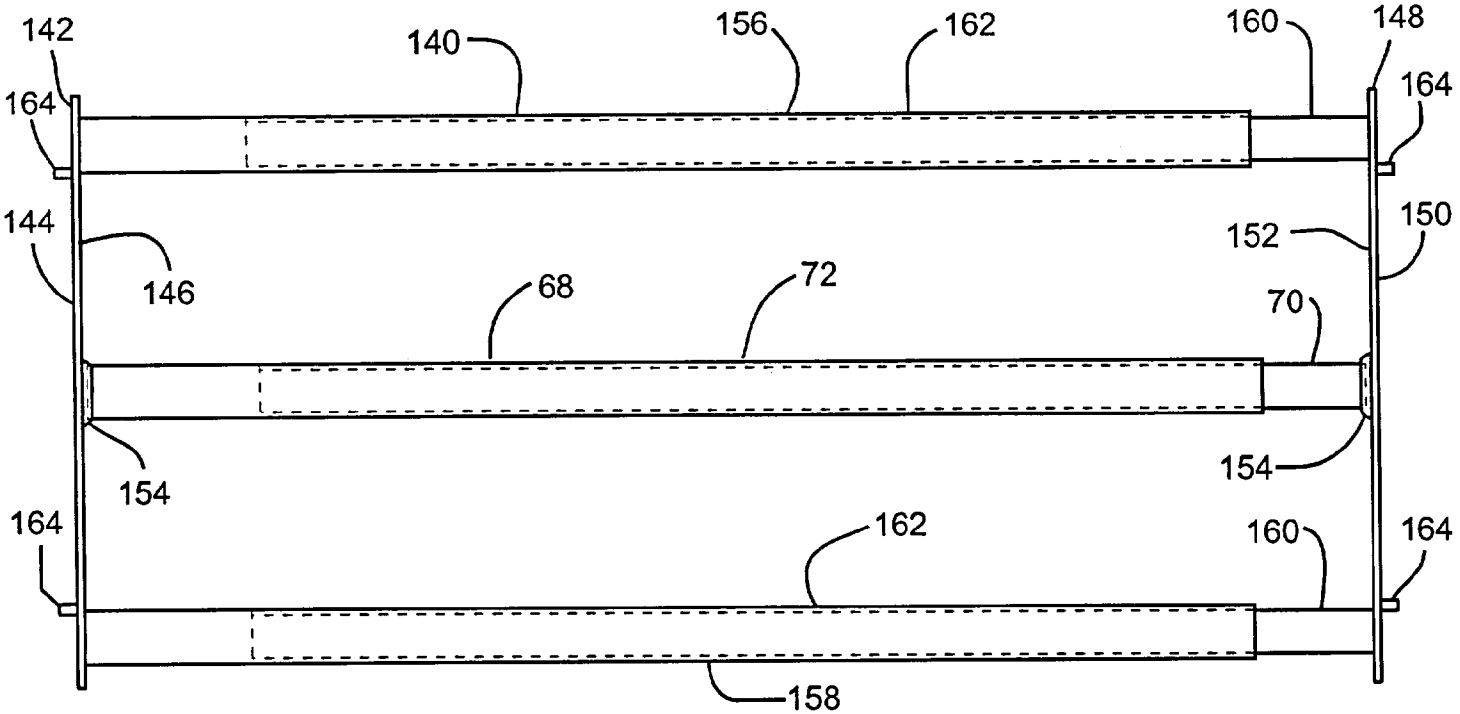
FIG. 10 is a top view of a closet shelf engagement member according to the present invention.
Figure 12:
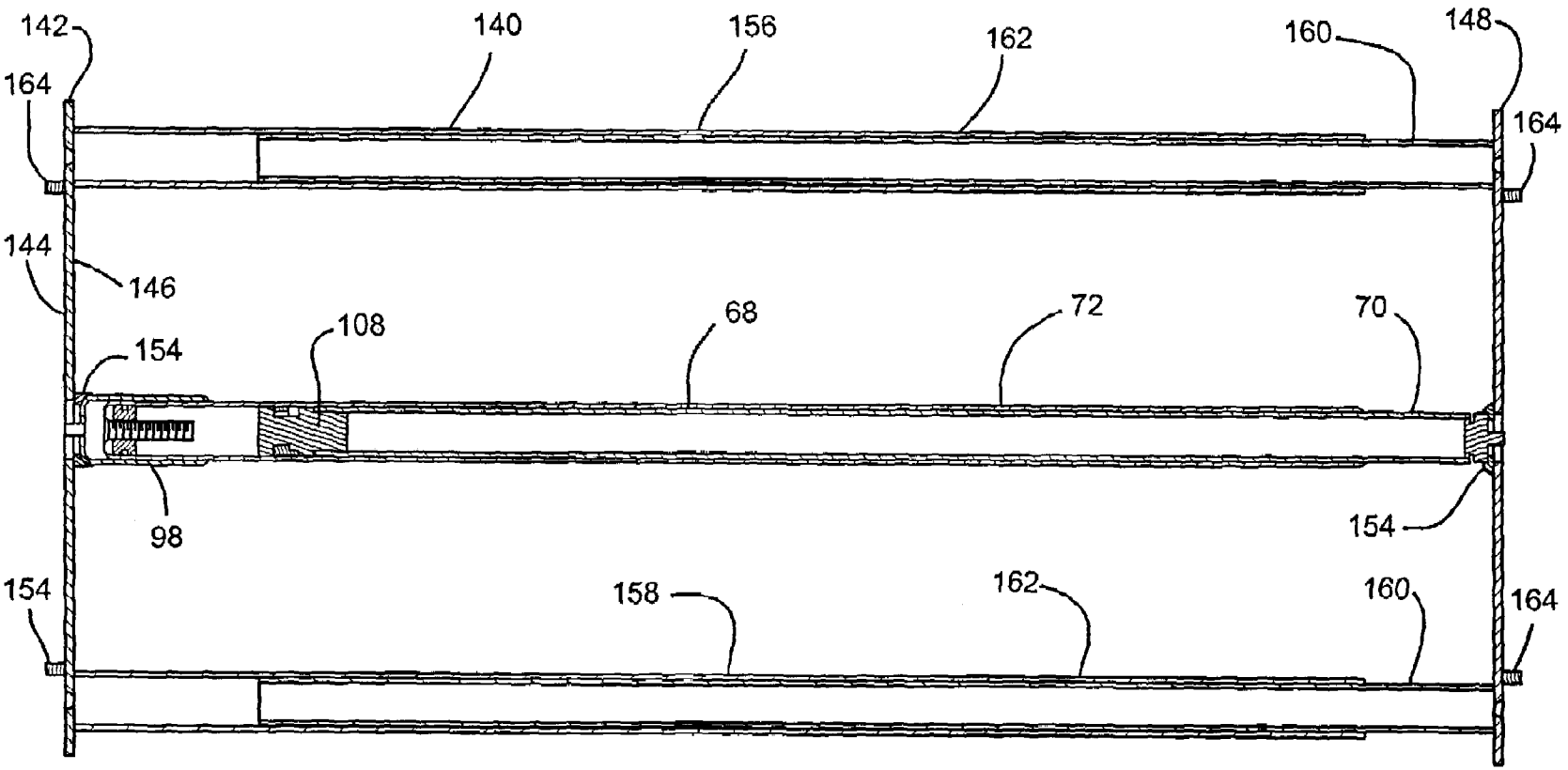
FIG. 12 is a cross-sectional view taken along line 12—12 of FIG. 11.

Referring to FIGS. 10–12, an adjustable and lockable engagement member such as a closet rod shelf 140 is shown. The shelf 140 includes a rod 68 that has the same elements as shown in FIGS. 8 and 9. Accordingly, the same reference numbers have been used. The shelf 140 includes a first end plate 142 having an outer surface 144 and an inner surface 146. The shelf 140 further includes a second end plate 148 having an outer surface 150 and an inner surface 152. The rod 68 extends between the inner surfaces 146 and 152 of the first and second end plates 142 and 148, respectively. The rod 68 is attached to the first and second end plates 142 and 148 by spring washers 154. The shelf 140 includes two nonlockable outer rods 156 and 158 that extend between the inner surfaces 156 and 152 of the first and second end plates 142 and 148, respectively, in which the rod 68 is positioned between the outer rods. Each of the outer rods 156 and 158 includes a first section 160 slidingly positioned in a second section 162. Each of the first and second end plates 142 and 148 includes projections 164 that are sized and adapted to be positioned in the openings 56 and 66 as shown in FIGS. 1–7. In this embodiment, each end plate 142 and 148 includes two spaced projections 164 positioned adjacent to the outer rods 156 and 158. In a preferred embodiment, the rod 68 (with the exception of a plastic locking device 108), the outer rods 156 and 158 and the first and second end plates 142 and 148 are constructed of metal.

In operation, the shelf 140 can be adjusted by sliding the first and second sections of the rod 68 and the outer rods 156 and 158 to a desired length. In this embodiment, the shelf 140 can be adjusted within a range of 23 to 36 inches. The rod 68 can then be operated as described above to lock the first and second sections 70 and 72 together.

Figure 14:
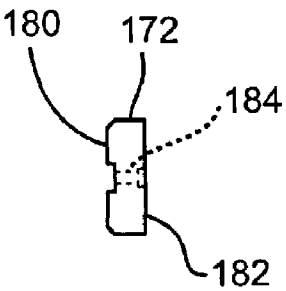
FIG. 14 is a side elevational view of the vertical support member shown in FIG. 13.
Figure 13:
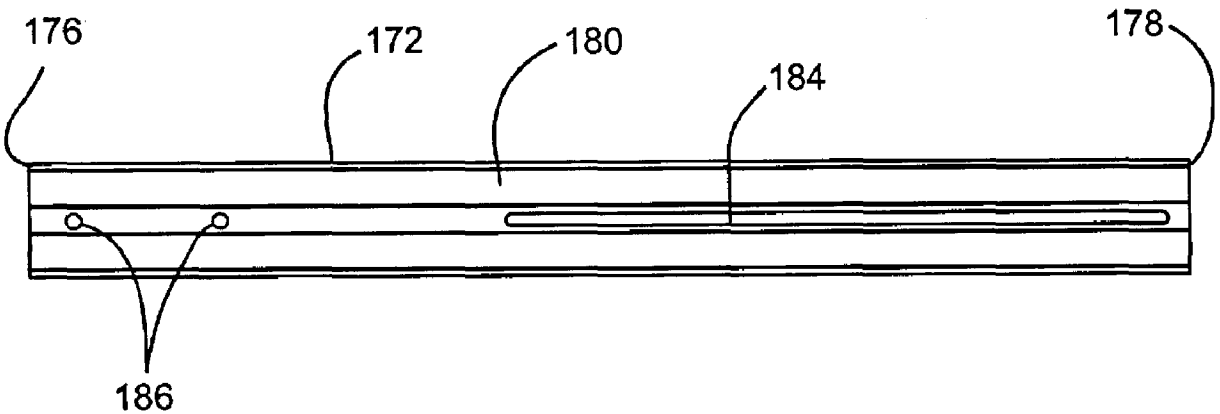
FIG. 13 is a top view of a vertical support member according to the present invention.
Figure 16:
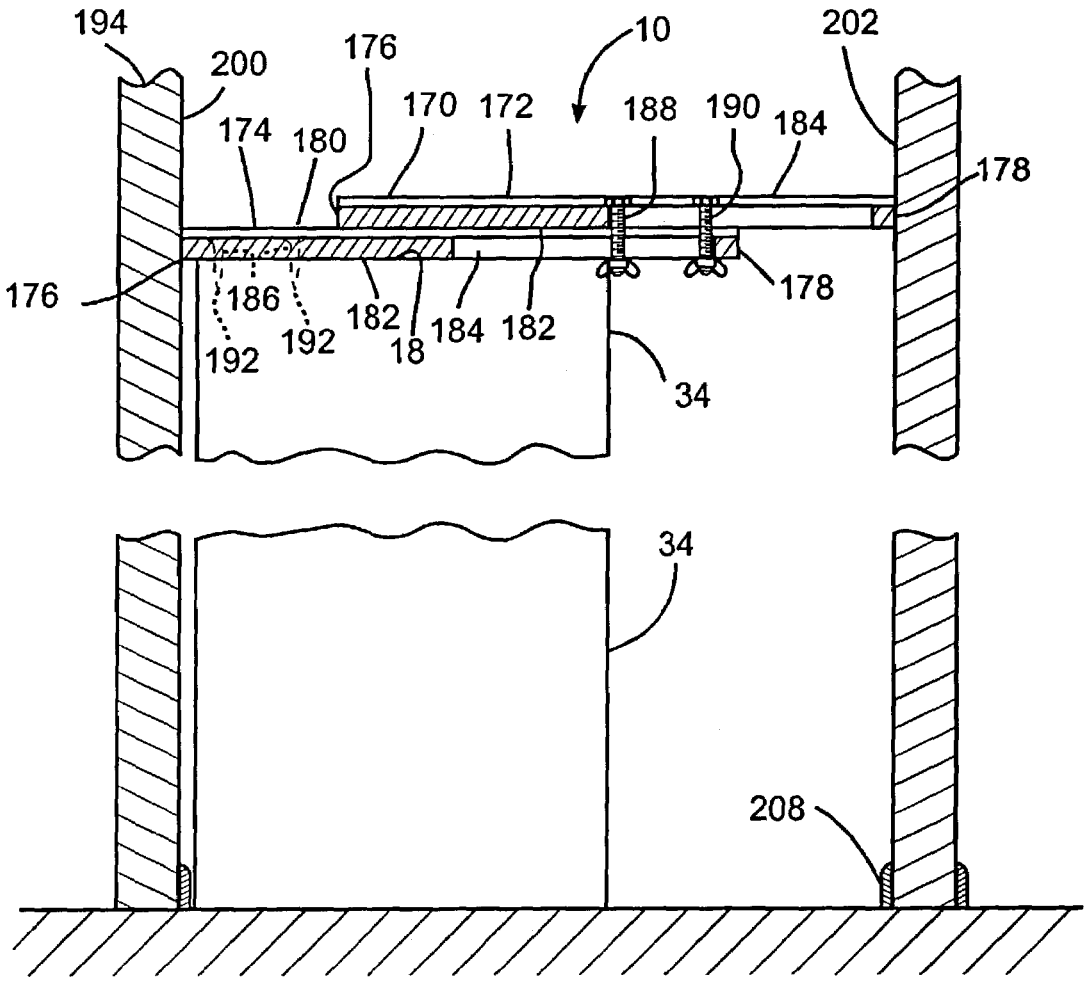
FIG. 16 is a cross-sectional view taken along line 16—16 of FIG. 15.

Referring to FIGS. 13, 14 and 16, the system 10 includes and an adjustable and lockable vertical securement device 170. The device 170 includes an upper member 172 and a lower member 174. As shown in FIGS. 13 and 14, the upper and lower members 172 and 174, as represented by upper member 172, includes a first end 176, a second end 178, a top surface 180 and a bottom surface 182. A longitudinally extending groove 184 extends between the top and bottom surfaces 180 and 182. Two openings 186 extend between the top and bottom surfaces 180 and 182 adjacent to the first end 176. As shown in FIG. 16, the upper member 172 is positioned with respect to the lower member 174 so that the bottom surface 182 of the upper member engages the top surface 180 of the lower member so that the grooves 184 of the upper and lower members are aligned. Fastening devices such as a first bolt and wing nut assembly 188 and a second bolt and wing nut assembly 190 extend through the grooves 184. The wing nuts are tightened until they engage the bottom surface 182 of the lower member 174 to lock the upper member 172 to the lower member 174. As shown in FIG. 16, fastening devices such as screws 192 are inserted through the openings 186 of the lower member 174 to attach the lower member to, for example, the top 18 of the storage component 34.

Figure 15:
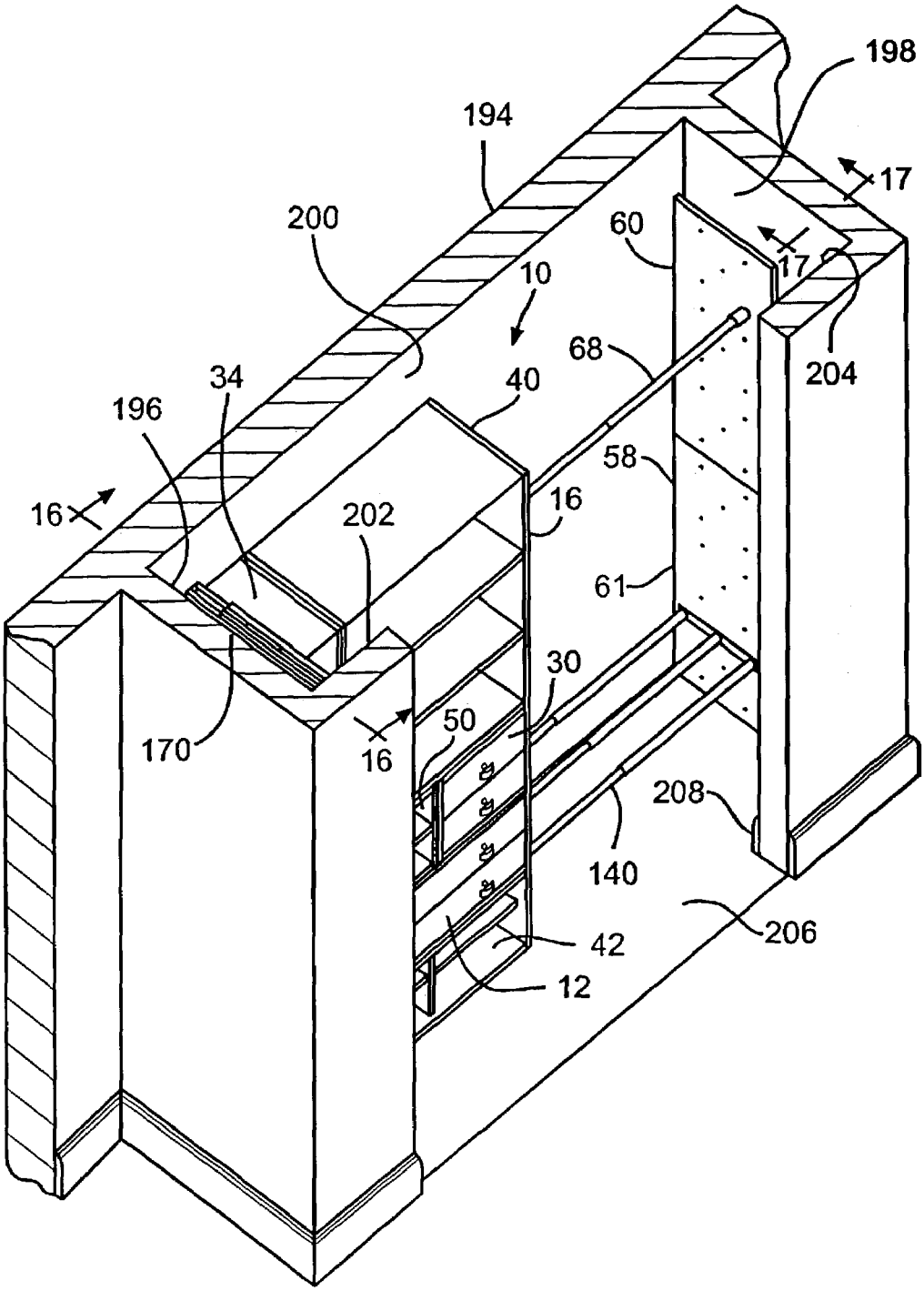
FIG. 15 is a perspective view of a closet storage system according to the present invention positioned in a closet.

Referring to FIG. 15, a closet storage system 10 according to the present invention is shown positioned within a closet 194 having a first sidewall 196, a second sidewall 198, a back wall 200, a first front wall 202, a second front wall 204 and a floor 206. The closet 194 also includes baseboard 208 adjacent the floor 206.

Referring to FIGS. 15–17, the embodiment of the closet system 10 as shown includes two stacked storage components 34 positioned adjacent to the first sidewall 196 of the closet 194. The system 10 includes a stack of storage components 42, 50, 30 and 40 positioned adjacent to the components 34. The system 10 further includes an upright member 58 positioned adjacent to the second sidewall 198 of the closet 194. As shown in FIG. 17, a first cleat 210 and a second cleat 212 are positioned between the second side 65 of the upright member 58 and the second sidewall 198 above and below the connection member 63. The first and second cleats 210 and 212 space the upright member 58 with respect to the second sidewall 198 to compensate for the connection member 63 and the base board 208.

As shown in FIG. 15, a rod 68 extends between the second sidewall 16 of the storage component 40 and the upper section 60 of the upright member 58. In this embodiment, the projection 84 of the rod 68 is positioned in one of the openings 56 of the component 40 and the projection 106 of the rod is positioned in one of the openings 66 of the upright member 58.

Still referring to FIG. 15, the rod shelf 140 extends between the component 42 and the lower section 61 of the upright member 58. The projections 164 of the shelf 140 are positioned in the openings 56 of the component 42 and the projections 164 at the opposite end of the shelf 140 are positioned in the openings 66 of the upright member 58.

When the rod 68 and the rod shelf 140 are adjusted and locked, they exert force against the storage components 34 and the upright member 58 so that they firmly engage the first and second sidewalls 196 and 198 of the closet 194 to horizontally secure the system 10 in position.

As shown in FIG. 16, the vertical securement device 170 firmly engages the back wall 200 and the first front wall 202 of the closet 194 to vertically secure the system in position. In this regard, the first end 176 of the lower member 174 engages the back wall 200 and the second end 178 of the upper member 172 engages the first front wall 202. As it will be appreciated, the system 10 can be positioned within a closet 194 without the use of any screws, bolts or brackets that could damage the closet walls. Further, the system 10 can be disassembled and removed from the closet without damage to the closet walls.

Referring to FIG. 18, an alternative embodiment system 10 according to the present invention is shown. In this embodiment, the system 10 includes first and second cleats 210 and 212, an upright member 58, two rods 68, a rod shelf 140 and a stack of components 42, 12, 50, 30 and 40. The system includes a stack of two components 34. The system 10 further includes a vertical securement device 170, as shown in FIG. 16. It should be understood that alternative embodiment systems 10 can consist of many different combinations of components, closet rods and closet rod shelves.

Referring to FIGS. 19 and 20, an alternative embodiment closet storage system 10 according to the present invention is shown. This embodiment is for use in a walk-in closet 194 that does not include opposed sidewalls. Instead, the closet 194 has a back wall 200, a floor 206 and a sidewall 214. The system 10 includes, for example, a first stack of components 216 positioned adjacent to the back wall 200 and a second stack of components 218 positioned adjacent to the sidewall 214 at the intersection of the back wall 200 and the sidewall 214. An upright member 58 is positioned on the front of the second stack 218 adjacent to back wall 200. A rod 68 and a rod shelf 140 extend between the first stack 216 and the upright member 58.

As shown in FIGS. 19 and 20, an L-shaped bracket is used to stabilize the first,stack 216. The bracket 220 includes a minor portion 222 having an opening 224 for the positioning of a fastening device such as a screw 226 that extends into the back wall 200 of the closet 194. The bracket 220 includes a major portion 228, which is positioned perpendicularly to the minor portion 222. The major portion 228 includes openings 230 for receiving a fastening device such as a screw 232 that extends into the top 18 of the component 34. As it will be appreciated, the screw 226 creates a small hole in the back wall 200 that can be easily and quickly repaired.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A system comprising:

a storage component; and an adjustable and lockable engagement member for engaging said storage component to secure said storage component in position, said engagement member including a rod having a first section slidingly positioned in a second section and a locking device positioned on said first section to lock said first section to said second section, said locking device including an eccentric cam rotatably mounted on an off-center portion of a cam holder, wherein turning of said first section in a first direction with respect to said second section causes said cam to engage said second section to lock said first section to said second section and turning said first section in a second direction opposite to said first direction cause said first and second sections to unlock.

2. The system of claim 1, wherein said storage component includes spaced first and second sidewalls, said engagement member engaging one of said sidewalls.

3. The system of claim 2, wherein said storage component includes at least one drawer positioned between said sidewalls.

4. The system of claim 2, wherein said storage component includes at least one shelf positioned between said sidewalls.

5. The system of claim 1, wherein said engagement member includes said rod positioned between at least two nonlockable rods.

6. The system of claim 5, wherein said engagement member includes spaced first and second end plates, said rod and said at least two nonlockable rods extending between said first and second end plates.

7. The system of claim 1, wherein said system includes an upright member having a first side and a second side, said engagement member engaging said storage component and said first side of said upright member to secure said storage component in position.

8. The system of claim 7, wherein said system includes at least one cleat positioned on said second side of said upright member.

9. The system of claim 1, wherein said storage component has a sidewall defining an opening and said engagement member has a projection being sized and adapted for insertion in said opening.

10. The system of claim 1, wherein said system has an upright member defining an opening and said engagement member has a projection being sized and adapted for insertion in said opening.

11. The system of claim 1, wherein said storage component has a component sidewall defining a component sidewall opening and said system has an upright including an upright sidewall defining an upright sidewall opening, said engagement member having a first projection being sized and adapted for insertion in said component sidewall opening and a second projection being sized and adapted for insertion in said upright sidewall opening.

12. The system of claim 1, wherein said system has an adjustable and lockable vertical securement device.

13. The system of claim 12, wherein said vertical securement device includes an upper member and a lower member, one of said members being sized and adapted for attachment to said storage component and the other of said members having an end sized and adapted for engaging a wall.

14. The system of claim 1, wherein said system has a generally L-shaped bracket having a first portion being sized and adapted for attachment to a wall and a second portion being sized and adapted for engaging said storage component.

* * * * *